US006336257B1

(12) United States Patent
Lang

(10) Patent No.: US 6,336,257 B1
(45) Date of Patent: Jan. 8, 2002

(54) FINE-TOOTHED COMBING STRUCTURE OF AN OPENING ROLLER FOR AN OPEN-END SPINNING MACHINE

(75) Inventor: Kurt Lang, Lauterstein (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/551,881

(22) Filed: Apr. 18, 2000

(30) Foreign Application Priority Data

May 12, 1999 (DE) ..... 199 21 965

(51) Int. Cl.[7] ..... D01G 15/84
(52) U.S. Cl. ..... 19/114; 19/105; 19/112
(58) Field of Search ..... 19/100, 101, 105, 19/106 R, 108, 112, 114, 115 A, 115 R, 128, 215, 217, 233; 57/408

(56) References Cited

U.S. PATENT DOCUMENTS

| | | | | |
|---|---|---|---|---|
| 3,772,739 A | * | 11/1973 | Lovgren | 19/105 |
| 4,937,919 A | * | 7/1990 | Graf | 19/114 |
| 4,953,264 A | * | 9/1990 | Hollingsworth et al. | 19/114 |
| 5,642,611 A | * | 7/1997 | Stahlecker | 19/112 |
| 5,655,262 A | * | 8/1997 | Sterin et al. | 19/114 |
| 5,701,637 A | * | 12/1997 | Graf | 19/114 |
| 6,061,877 A | * | 5/2000 | Leifeld et al. | 19/105 |

* cited by examiner

*Primary Examiner*—Danny Worrell
*Assistant Examiner*—Gary L. Welch
(74) *Attorney, Agent, or Firm*—Crowell & Moring LLP

(57) ABSTRACT

The present invention relates to a fine-toothed combing structure of an opening roller for an open-end spining machine. The teeth of the fine-toothed combing structure have a spacing which measures at least three times the height of the teeth. The front angle should not measure more than 10°. This fine-toothed combing structure is preferably used for synthetic fibers.

16 Claims, 1 Drawing Sheet

FINE-TOOTHED COMBING STRUCTURE OF AN OPENING ROLLER FOR AN OPEN-END SPINNING MACHINE

BACKGROUND AND SUMMARY OF THE INVENTION

This application claims the priority of Patent Document 199 21 965.6, filed May 12, 1999, the disclosure of which is expressly incorporated by reference herein.

The present invention relates to a fine-toothed combing structure of an opening roller for an open-end spinning machine, comprising teeth whose spacing significantly exceeds the height of the teeth and which teeth have a positive front angle.

A fine-toothed combing structure is understood as one having a tooth height measuring less than 2 mm, and when, in comparison to the height of the teeth, there is a relatively large spacing. Such fine-toothed combing structure were originally developed in order to combine the positive features of both standard toothed combing structure and needle rollers (see Artzt/Egbers, Technology of Rotor Spinning, Melliand 1979). In practice, fine-toothed combing structure are primarily applied in the spinning of synthetic fiber material. Opened fibers from such material are relatively stiff and tend, at the entrance to the feeding channel, not to leave the teeth of the opening roller when they should. For this reason, extremely fine teeth have proven to be effective, as the fibers do not penetrate too deeply into the fine-toothed combing structure and therefore can be reliably further transported into the feeding channel. For opening the fibers from the fed fiber material, however, teeth having features counter to the ones mentioned above are more advantageous. For example, a relatively large front angle is purposeful for opening, while the same large front angle is counterproductive to releasing the single fibers at the entrance to the feeding channel. This disadvantage can be partly compensated for by increasing the speed of the opening roller, whereby there is then the risk that the single fibers will come into contact too often with the teeth, owing to the large number of same, thus leading to fiber damage.

It is an object of the present invention, in particular in the case of synthetic fiber materials having stiffer fibers, to find a suitable compromise in regard to the fine-toothed combing structure so that, on the one hand, the fiber material can be opened reliably, and on the other hand that the transported fibers can be released at the right time to the feeding channel. These advantageous features should also be effective in the eventuality of a speed increase of the opening roller.

This object has been achieved in accordance with the present invention in that the spacing of the teeth measures at least three times that of the height of the teeth and in that the front angle measures a maximum of 10°.

Because of the increased tooth spacing in relation to prior art, the number of teeth is reduced in such a way that the fibers do not receive any more knocks in the fine-toothed combing structure before they are released at the feeding channel than they would in a standard combing structure and at a slightly reduced speed of the opening roller. The front angle is of such a size that, on the one hand, it permits a reliable opening of the fiber material, and on the other hand is still small enough to permit the fibers a timely release from the fine-toothed combing structure.

In tests, dimensions, whereby the tooth spacing measures at least 4.5 mm, the front angle maximum 7.5 mm and the teeth height approximately 1.5 mm have proven to be a good compromise. If, in addition, the apex angle between the tooth front and the tooth back measures between 30° and 40°, the tooth flanks are still large enough to transport the opened fibers from the opening zone to the entrance of the feeding channel.

In a particularly advantageous embodiment of the present invention, the flank angle between two tooth flanks measures between 8° and 10°. It is hereby particularly favourable to make the tooth flanks symmetrical in relation to the tooth form. This is not possible with a standard wire combing structure. For this reason, a flank angle of this kind can only be realized when—as is indeed known—the teeth are ground from the solid material of the opening roller.

These and further objects, features and advantages of the present invention will become more readily apparent from the following detailed description thereof when taken in conjunction with the accompanying drawings. following detailed description thereof when taken in conjunction with the accompanying drawings.

DETAILED DESCRIPTION OF THE DRAWINGS

Figure 1:
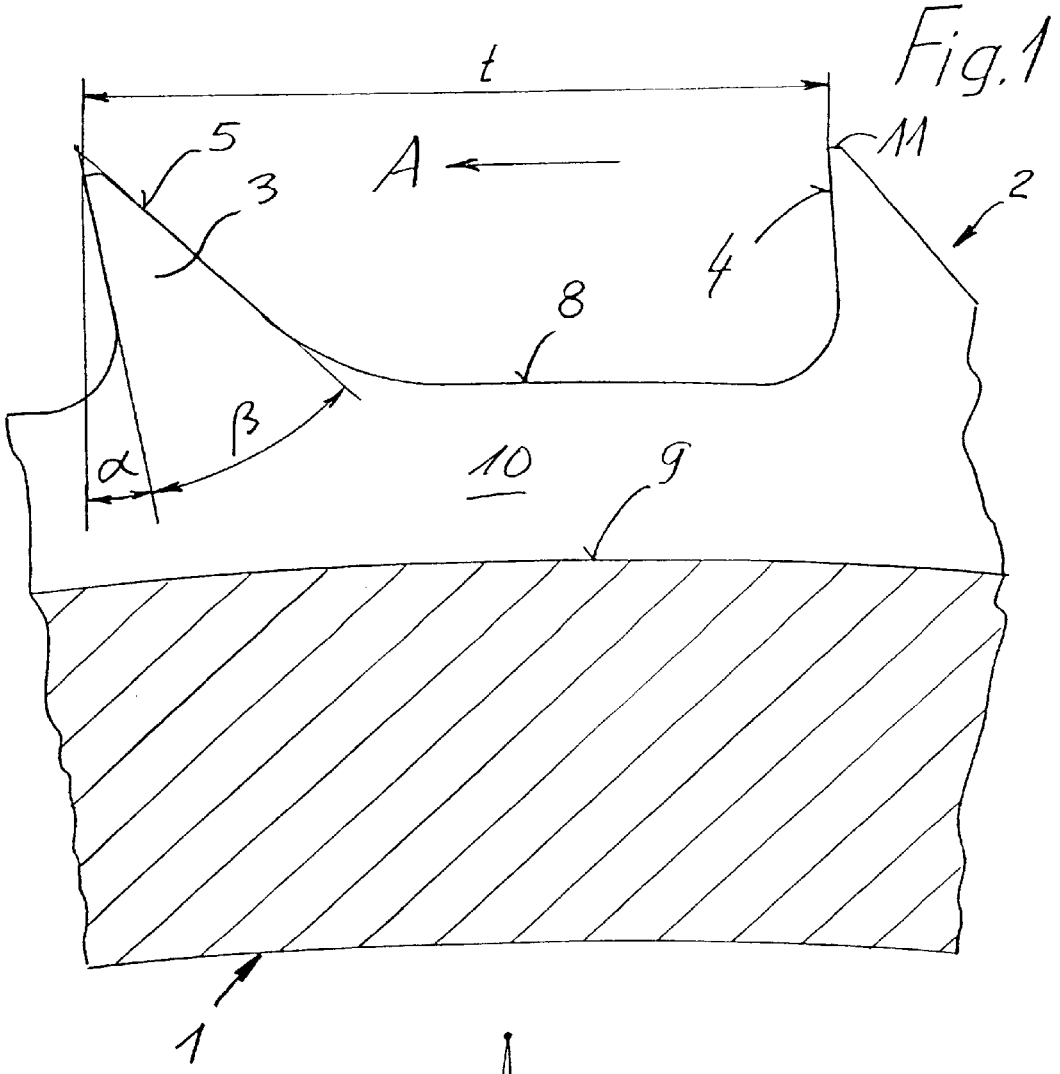
FIG. 1 is a greatly enlarged section of a fine-toothed combing structure according to the present invention, namely of a cross section through the axle of the opening roller.

The opening roller 1, shown only in sections, has a rotational direction A. The teeth 3 of the fine-toothed combing structure 2 have a tooth spacing t, which lies in the range of between 4.5 and 5 mm and preferably approximately 4.8 mm, The teeth height h lies in the order of magnitude of 1.5 mm. The front angle $\alpha$ of the teeth 3 is positive and measures less than 10°, preferably 7.5°. The apex angle S located between the tooth front 4 and the tooth back 5 measures between 30° and 40° and can preferably measure 35° degrees.

The actual teeth 3 extend from a tooth base 8 to a tooth tip 11. They graduate on the side facing away from the tooth tip 11 into tooth grooves 10, which are defined below by a groove bottom 9. The fine-toothed combing structure 2 is preferably not made of a wire combing structure wound onto the opening roller 1, but rather is ground from the block material of the opening roller 1 in the known way.

Figure 2:
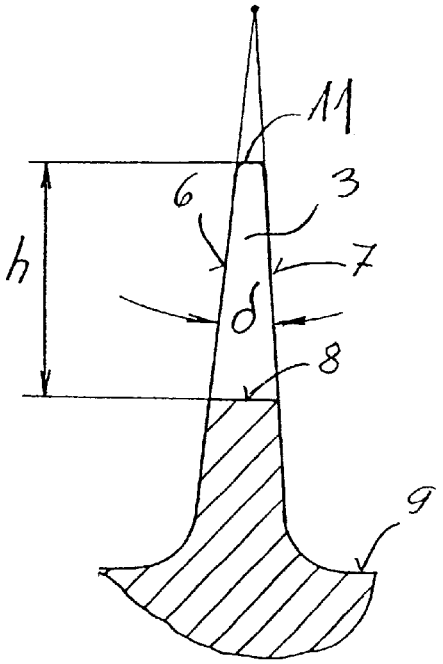
FIG. 2 is a single tooth of the fine-toothed combing structure as seen in the rotational direction of the opening roller.

The advantage of this type of manufacturing can be seen in FIG. 2, where the tooth flanks 6 and 7 extend symmetrically to an imagined center line of the tooth 3. A profiling of this type is not possible with a wire combing structure. The flank angle 6 located between the tooth flanks 6 and 7 measures advantageously between 8° and 10°.

The selected front angle is large enough so that single fibers can be opened from the fed fiber material, and on the other side small enough so that the transported single fibers are released in time from the fine-toothed combing structure 2 for entrance into a feeding channel (not shown). To support the release of the single fibers the speed of the opening roller can be increased as required, which does not have a negative effect with regard to the aggressivity of the fine-toothed combing structure 2, as the selected tooth spacing t is larger than normal.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fine-toothed combing structure of an opening roller for an open-end spinning machine, comprising teeth, whose spacing significantly exceeds a height of the teeth and which have a positive front angle, wherein the tooth spacing measures at least three times the tooth height and no more than 5 mm and the front angle measures at most 10°.

2. A fine-toothed combing structure according to claim 1, wherein the tooth spacing measures at least 4.5 mm.

3. A fine-toothed combing structure according to claim 2, wherein the front angle measures at most 7.5°.

4. A fine-toothed combing structure accordin to claim 2, wherein the tooth height measures approximately 1.5 mm.

5. A fine-toothed combing structure according to claim 2, wherein an apex angle between a tooth front and a tooth back measure between 30° and 40°.

6. A fine-toothed combing structure according to claim 2, wherein a flank angle between two tooth flanks measures between 8° and 10°.

7. A fine-toothed combing structure according to claim 1, wherein the front angle measures at most 7.5°.

8. A fine-toothed combing structure according to claim 7, wherein the tooth height measures approximately 1.5 mm.

9. A fine-toothed combing structure according to claim 7, wherein an apex angle between a tooth front and a tooth back measure between 30° and 40°.

10. A fine-toothed combing structure according to claim 7, wherein a flank angle between two tooth flanks measures between 8° and 10°.

11. A fine-toothed combing structure according to claim 1, wherein the tooth height measures approximately 1.5 mm.

12. A fine-toothed combine structure according to claim 11, wherein an apex angle between a tooth front and a tooth back measure between 30° and 40°.

13. A fine-toothed combing structure according to claim 11, wherein a flank angle between two tooth flanks measures between 8° and 10°.

14. A fine-toothed combing structure according to claim 1, wherein an apex angle between a tooth front and a tooth back measure between 30° and 40°.

15. A fine-toothed combing structure according to claim 14, wherein a flank angle between two tooth flanks measures between 8° and 10°.

16. A fine-toothed combing structure according to claim 1, wherein a flank angle between two tooth flanks measures between 8° and 10°.

* * * * *